United States Patent [19]

Dutt

[11] Patent Number: 4,759,976

[45] Date of Patent: Jul. 26, 1988

[54] FORMING FABRIC STRUCTURE TO RESIST REWET OF THE PAPER SHEET

[75] Inventor: William H. Dutt, Rensselaer, N.Y.

[73] Assignee: Albany International Corp., Menands, N.Y.

[21] Appl. No.: 44,996

[22] Filed: Apr. 30, 1987

[51] Int. Cl.[4] ..... B32B 7/00

[52] U.S. Cl. ..... 428/257; 139/383 AA; 162/348; 162/DIG. 1; 428/259; 428/225

[58] Field of Search ..... 162/348, DIG. 1; 139/383 AA; 428/246, 257, 233, 259, 225

[56] References Cited

U.S. PATENT DOCUMENTS

| | | | |
|---|---|---|---|
| 2,110,388 | 3/1938 | Asten | 139/383 A |
| 2,423,828 | 7/1947 | Chagnon | 139/383 A |
| 3,086,276 | 4/1963 | Bartz et al. | 139/383 A |
| 3,573,089 | 3/1971 | Tate | 162/348 |
| 3,915,202 | 10/1975 | Curtis et al. | 162/348 |
| 4,162,190 | 7/1979 | Ashworth | 428/280 |
| 4,515,853 | 5/1985 | Borel | 162/348 |

*Primary Examiner*—James J. Bell

*Attorney, Agent, or Firm*—Kane, Dalsimer, Sullivan, Kurucz, Levy Eisele and Richard

[57] ABSTRACT

Forming fabrics are made in multilayer construction, with a hydrophobic top layer and a hydrophilic base layer or layers. The fabric is advantageous in a forming wire, obviating rewet in a forming paper sheet.

6 Claims, 2 Drawing Sheets

FORMING FABRIC STRUCTURE TO RESIST REWET OF THE PAPER SHEET

BACKGROUND OF THE INVENTION

1. Field of The Invention

The invention relates to forming fabrics used in papermaking machines.

2. Brief Description of The Prior Art

Papermaking machines are well known in the art. The modern papermaking machine is in essence a device for removing water from the paper furnish. The water is removed sequentially in three stages or sections of the machine. In the first or forming section, the furnish is deposited on a moving forming wire and water drained through the wire to leave a paper sheet or web having a solids content of circa 18 to 25 percent by weight. The formed web is carried into a wet press felt section and passed through one or more nip presses on a moving press felt to remove sufficient water to form a sheet. This sheet is transferred to the dryer section of the papermaking machine.

On papermaking machines, endless belts are employed in the various sections to carry the sheet or web. One form of belt which has been used extensively as a forming wire in the forming section of the papermaking machine is one fabricated from an open, multi-layer weave of synthetic, polymeric resin monofilaments. Such fabrics generally perform well in the forming section although there are certain limitations. For example, in the multi-layered weaves there is a tendency for the dry content of the sheet of forming paper to decrease after the last point of vacuum application on the machine, just prior to transfer of the sheet to the wet-press section of the machine. This decrease in dry content is termed "rewet". It is theorized that multiple layer forming fabrics carry water within the weave geometry and that as the sheet of formed paper is carried by the forming fabric beyond the last vacuum application, water migrates back into the carried sheet from the forming fabric.

The forming fabrics of the invention minimize or eliminate the "rewet" phenomena and are therefore advantageous in promoting overall drying efficiency in the forming section of a papermaking machine.

SUMMARY OF THE INVENTION

The invention comprises, in a multi-layered papermachine forming fabric which comprises a top layer for contacting the forming paper sheet and an underlying layer for supporting the top layer, said multi-layers each comprising interwoven warp and weft yarns, the improvement, which comprises said top layer being hydrophobic and said underlying layer being hydrophilic.

DETAILED DESCRIPTION OF THE PREFERRED EMBODIMENTS OF THE INVENTION

Those skilled in the art will gain an appreciation of the preferred embodiments of the invention by a reading of the following description in conjunction with a viewing of the accompanying drawings of FIGS. 1–4, inclusive.

Figure 1:
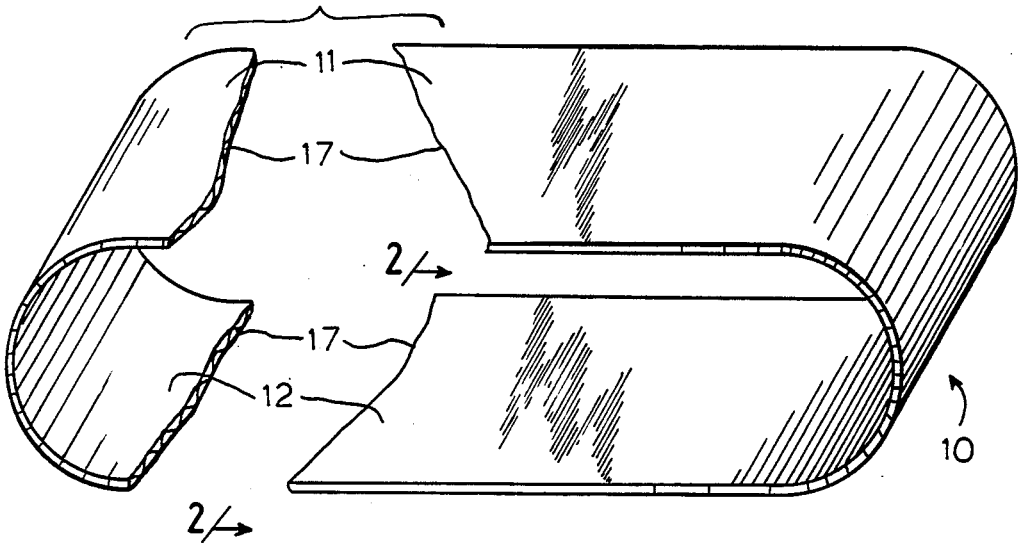
FIG. 1 is a partially fragmented schematic perspective view of the improved endless Fourdrinier forming belt fabric of this invention.

The preferred embodiment of the improved Fourdrinier forming fabric of the present invention is broadly designated at 10 in FIG. 1 and comprises an outer or face ply or layer 11 and an inner or backing ply or layer 12 which are arranged in superposed relationship, and both of which are preferably in endless form. The outer and inner plies 11, 12 also may be termed as respective top and bottom plies of the fabric, since the plies 11, 12 occupy such position when in use the when passing through the slurry-receiving upper reach of the forming fabric.

At least the top or outer ply 11 should be of a relatively fine mesh weave and, in any event, both of the plies 11, 12 should be of a mesh weave having at least 9 percent open area so as to readily permit drainage therethrough of liquid from a slurry. The outer or top ply 11 is woven of main warp yarns 13 and weft yarns 14, and the inner or bottom ply 12 is woven of main warp yarns 15 and weft yarns 16. Although each of the plies 11, 12 is shown as being in the form of a plain weave, it is to be understood that they may be of any other suitable weave constructions.

The outer and inner plies 11, 12 of the fabric 10 are separate of each other. However, the plies 11, 12 are interconnected by a plurality of interlacing binder warp yarns 17 which extend generally parallel with the main warp yarns 13, 15 and which extend transversely across the fabric 10 (FIG. 1). It is preferred that there are at least twice as many main warp yarns 13, 15 in each respective layer of the fabric 10 as there are binder warp yarns 17. Also, it is preferred that the binder warp yarns 17 are spaced weftwise apart from each o there as shown in FIGS. 3 and 4, for example, so that the outer and inner plies 11, 12 may shift or yield relative to each other when the fabric 10 is in use and as successive portions of the belt fabric are moving in engagement with the cylindrical surfaces of supporting rolls of a papermaking machine, thereby reducing the abrasive action to which the inner or bottom ply 12 may be subjected by frictional engagement with such surfaces.

Alternatively, the fabric 10 of the invention may be unitary, multi-layer structure free of binder yarns. The yarns 13, 14 are integrated with the base yarns 15, 16 by a warp yarn 13 from the top layer which occasionally dips to interweave with a weft yarn 16 in the fabric base layer, thereby providing what is commonly referred to in the art as a "stitching point." The entire fabric structure 10 may be characterized as a smooth faced, multilayer weave. The fabric 10 may be woven on a conventional loom in a single operation. The base yarns 15, 16 are woven while the top yarns 13, 14 are woven directly above the a base yarns 15, 16. The combining of the two yarn systems is performed during the weaving operation by sinking one of the yarns 13 to interlace with one of the base layer yarns 16 to provide the stitching points. The combining of the two systems is preferably in a set sequence, for example on every other yarn 16 so as not to distort either the upper layer yarn surface or the lower yarn base layer.

Other multi-layered forming wire fabric constructions known to the art may be improved by the present invention.

Figure 2:
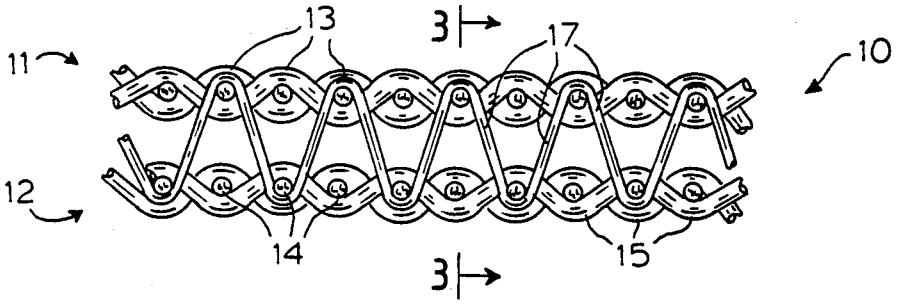
FIG. 2 is a schematic transverse or warpwise sectional view through a portion of the improved Fourdrinier fabric taken substantially along line 2—2 in FIG. 1.
Figure 3:
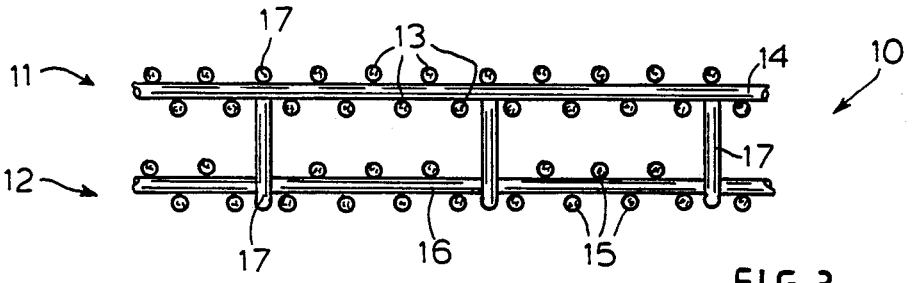
FIG. 3 is a fragmentary weftwise sectional view taken substantially along line 3—3 in FIG. 2.
Figure 4:
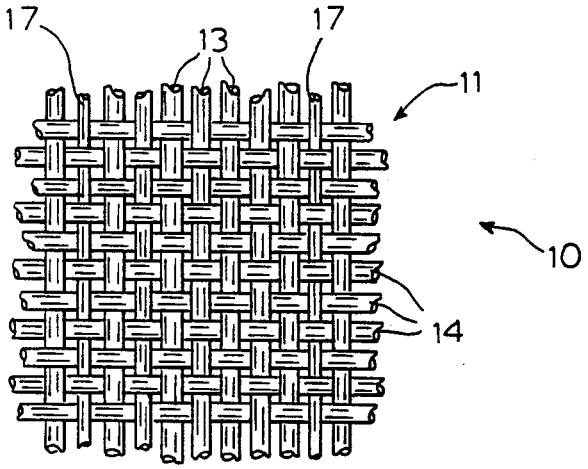
FIG. 4 is an enlarged fragmentary top plan view of a portion of the fabric making up the belt of FIG. 1.

As shown in FIGS. 2 and 3, the plies 11, 12 are spaced apart for purposes of clarity. However, it is to be understood that the two plies actually are held in contact with each other by the binder warp yarns 17. As indicated above, it is preferred that there is a lesser number of binder warp yarns 17 in the Fourdrinier forming belt fabric 10 than there are warp yarns in each ply 11, 12 thereof. As shown in FIGS. 3 and 4, there is one binder warp yarn for every seven main warp yarns in each ply, for example. Also, binder warp yarns 17 may be somewhat smaller than at least the warp and weft yarns 13, 14 of the outer or face play 11, if desired. As preferred, the binder warp yarns 17 are looped over alternate weft yarns 14 in outer ply 11 and they are looped beneath intervening weft yarns 16 in inner ply 12 of fabric 10.

When the Fourdrinier belt fabric 10 is woven in endless form, as shown in FIG. 1, it is to be noted that the weft yarns 14, 16 in the two plies 11, 12 are continuous and extend longitudinally throughout the upper and lower reaches of the Fourdrinier forming belt fabric and, since the belt fabric 10 is woven in a progressive manner the weft yarns 14, 16 extend in generally helical form progressing from one edge of the fabric to the other. Of course, the warp yarns 13, 15 17 of the endless Fourdrinier forming belt fabric extend transversely or across the belt fabric.

The yarns 13, 14, 15, 16 and 17 may be selected from a wide variety of known and conventionally used yarns, subject to the requirement for hydrophobicity/hydrophilicity described more fully hereinafter. Thus, the yarns 13, 14 15, 16 and 17 may be selected from, for example, multi-filament yarns, monofiliment yarns or metal yarns covered with synthetic.

If plastic coated yarns are employed in weaving the fabric 10, it is preferred that they are used to extend in only the widthwise direction of the fabric formed therefrom and with yarns of more pliable synthetic and/or natural textile material extending in the lengthwise direction of the belt. By such an arrangement of the plastic coated metal yarns, they would be subjected to relatively little or not flexing as they passed about rolls and over the edges of suction box tops of a forming machine.

Further, if synthetic yarns are used, it is preferred that the fabric is heat-set to aid in preventing stretching, and it is preferred that the yarns are of the continuous filament type since they would normally be of greater tensile strength than staple-fiber synthetic yarns. In general, heat-setting may be carried out at temperatures of from about 150° F. to 400° F. for from 15 to 60 minutes. The degree of heat-setting required to achieve the desired structure of the fabric will of course vary depending on the polymer nature of the yarns. However, optimum times, temperatures and tensions placed on the fabric during heat-setting can be determined by those skilled in the art, employing trial and error technique for the difference yarn materials. Typical synthetic yarns which may be used in the manufacture of the belt fabric may be formed from nylon, polyester, acrylic, polypropylene or other synthetic strand materials. As shown, all of the main warp yarns 13, 15 and the weft yarns 14, 16 are about he same size. It is apparent, however that may different sizes and types of yarns may be used in forming the fabric 10 in accordance with this invention.

In the improved fabric 10 of the invention, the top layer or ply 11 is hydrophobic in character while the underlying layer or ply 12 is hydrophilic in character. In other words, the top ply 11 will be water-repellent while the underlying play 12 will have an affinity for water. More specifically, the top play 11 may be composed of yarns and fibers that are hydrophobic either due to their basic polymeric character or to a treatment to promote water-repellency such as a treatment with a fluorochemical water-repellent. Such treatments are well known; see for example Kirk-Othmer Encyclopedia of Chemistry, Vol. 22, page 146.

The fibers and yarns composing the underlying ply 12 may be hydrophilic either because of the hydrophilic nature of the yarns or as a result of treatment with, for example a surfactant. Surfactant treatments of the ply 12 will also enhance hydrophilicity.

The term "surfactant" as used herein is a contraction of "surface-active agent" and is broadly descriptive term used to describe a chemical compound which is (1) soluble in at least one phase of a system, (2) has an amphipathic structure, (3) the molecules of which form oriented monolayers at phase interfaces, (4) exhibits an equilibrium concentration as a solute at a phase interface, greater than its concentration in the bulk of the solution, (5) forms micelles when the concentration as a soluted in solution, exceeds a characteristic limiting value and (6) exhibits some combination of the functional properties of detergency, foaming, wetting, emulsifying, solubilizing and dispersing. Surface-active agents are generally classed as anionic, cationic or non-ionic. Preferred as surface-active agents in the method of the invention are those of the non-ionic type. Non-ionic surface active agents are generally well-known as is the method of their preparation. Representative are the alkylphenoxypoly (ethyleneoxy) ethanols such as they octylphenoxypoly (ethyleneoxy) ethanols and nonylphenoxypoly (ethyleneoxy) ethanols having polyoxyethylene moieties averaging from 8 to 15 units in length. Other non-ionic surfactants which may be employed are represented by polyethylene oxides, polypropylene oxides, long chain alkyl phosphine oxides, long chain alkylamine oxides and the like.

Other chemicals may impart either hydrophobic or hydrophilic characteristics and my be used to help in improving the water removal capabilities of the fabrics used in paper making applications.

In use, the top ply 12 of the fabric 10 receives the wet paper web formed thereon. At the last point of vacuum application, water is drawn from the sheet, into the multi-layered forming fabric. Because of the hydrophobic/hydrophilic nature of the weave geometry, the water is attracted preferentially to the bottom layer or layers, thereby minimizing water availability to the top layer. Rewet of the paper web is minimized or avoided.

As shown in FIG. 4, a top view of a portion of the fabric 10, the duplex weave is relatively open, i.e.; has at least about a 9 percent open area. The 9% open area through the belt fabric 10 generally is suitable to accommodate a slurry of pulp and water containing relatively short and fine fibers during the formation of a sheet of paper or the like thereon. In instances where the fibers of the slurry are appreciably longer, it is apparent that a more open mesh weave may be employed. IN any event, the open area of each ply should be such as to permit a rate of drainage of the liquid therethrough facilitating the formation of a sheet of paper of the desired quality upon the outer or face surface of the Fourdrinier forming belt fabric.

When the belt fabric is in use, the inner ply 12 thereto is subjected to the larger portion of the wear of the composite fabric, thereby generally protecting the warp and weft yarns 13, 14 of the face ply from frictional wear, since a substantially greater portions of the frictional wear occurs on the back or inner side of a Fourdrinier forming belt fabric than that occurring on the face or outer side thereof; e.g., the inner ply may creep in frictional engagement with the various rolls and may slide over and against foils, suction box tops and other supporting surfaces of a forming machine. Also, it is apparent that the inner ply 12 not only reinforces the top or outer ply 11, but it also enhances the dimensional stability of the forming fabric. The stability of the fabric 10 may be further enhanced by bonding the two plies 11, 12 together at suitably spaced areas, if desired. Such bonding may be effected by use of a suitable adhesive and/or by heat fusion or the plies together at such spaced areas.

It is preferred that the fabric 10 is woven in endless form, as described herein, so that the weft yarns thereof will extend lengthwise along the belt formed therefrom. It is apparent, however, that the fabric may be woven of the desired weftwise width and in indefinite warpwise lengths, after which the fabric may be cut to the desired warpwise lengths and opposite ends thereof then may be suitably spliced together to form an endless belt therefrom.

The following example describes the manner and the process of making and using the invention and sets forth the best mode contemplated by then inventor of carrying out the invention but is not to be considered as limiting.

EXAMPLE

A fabric is prepared in a weave of 0.020" diameter polypropylene monofilament machine direction yarns totalling 56 ends per inch interwoven with 0.020" diameter monofilament polyester cross-machine direction yarns totalling 40 picks per inch (20 top and 20 bottom in a two layer weave). After heat-setting, a fabric is obtained which has a smooth surface contacting outer plane. The upper surface is treated with a chrome complex of a perfluorocarbonylic acid.

This fabric may be made endless through he use of the well-known joining procedure whereby the ends of the fabric are woven one into the other, or by the use of the pin seam. The fabric provides superior sheet support with reduced rewet to result in greater machine efficiencies.

The forming wires of the invention may also be finished by any conventional manner, i.e.; for example chemical treatments to offer specific properties of runability and resistance to chemical and abrasive degradation.

I claim:

1. In a papermachine forming fabric which comprises a top layer for contacting the forming paper sheet and an underlying layer for supporting the top layer, said multi-layers each comprising interwoven warp and weft yarns, the improvement, which comprises said top layer being hydrophobic and said underlying layer being hydrophilic.

2. A papermachine forming fabric comprising at least two woven plies of respective sets of weft yarns and warp yarns, binder warp yarns interwoven with the interconnecting said two plies, the upper of said plies being fabricated from hydrophobic materials and the lower of said plies being fabricated from hydrophilic materials.

3. A papermachine forming fabric, which comprises:

a multi-ply fabric, including a top ply and a bottom ply;

said top and bottom plies each comprising interwoven warp and weft yarns;

said yarns in the top ply being hydrophobic;

said yarns in the bottom ply being hydrophilic.

4. The fabric of claim 3 wherein the hydrophobicity of the yarns is due to chemical treatment.

5. The fabric of claim 3 wherein hydrophilicity of the yarns is due to chemical treatment.

6. The fabric of claim 3 wherein the yarns are all monofilament yarns.

* * * * *